US008851310B2

(12) United States Patent
Pucci

(10) Patent No.: US 8,851,310 B2
(45) Date of Patent: Oct. 7, 2014

(54) CLOSURE FOR A CONTAINER

(75) Inventor: Fabrizio Pucci, Castel Guelfo di Bologna (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 13/522,287

(22) PCT Filed: Apr. 1, 2011

(86) PCT No.: PCT/EP2011/055149
§ 371 (c)(1),
(2), (4) Date: Jul. 13, 2012

(87) PCT Pub. No.: WO2011/121134

PCT Pub. Date: Oct. 6, 2011

(65) Prior Publication Data

US 2012/0292321 A1 Nov. 22, 2012

(30) Foreign Application Priority Data

Apr. 1, 2010 (EP) ..... 10159039

(51) Int. Cl.
*B65D 1/02* (2006.01)
*B65D 51/18* (2006.01)
*B65D 51/22* (2006.01)

(52) U.S. Cl.
CPC ..... *B65D 51/228* (2013.01); *B65D 2251/0015* (2013.01); *B65D 2251/0071* (2013.01)
USPC ..... 215/48; 215/47; 215/252; 215/256; 215/350; 220/255; 220/255.1; 220/256.1; 220/258.1; 220/258.3

(58) Field of Classification Search
CPC ..... A61J 1/1412; A61J 1/18; B65D 17/16; B65D 41/045; B65D 41/3428; B65D 51/1688; B65D 51/22; B65D 51/228; B65D 2251/0015; B65D 2251/0093; Y10S 215/01; Y10S 215/901; Y10S 425/809
USPC ..... 215/47–48, 228, 232, 250, 253, 256, 215/276, 349–351; 220/212, 265–266, 276, 220/284–285, 288, 293; 222/541.1, 541.6
IPC ..... B65D 01/02,17/28, 17/40, 53/04
See application file for complete search history.

(56) References Cited

U.S. PATENT DOCUMENTS 4,181,232 A * 1/1980 Bellamy et al. ..... 215/232
4,402,417 A * 9/1983 Corrigan et al. ..... 215/232

(Continued)

FOREIGN PATENT DOCUMENTS

CN 1496325 A 5/2004
CN 101316770 A 12/2008

(Continued)

OTHER PUBLICATIONS

International Search Report (PCT/ISA/210) issued on May 17, 2011, by the European Patent Office as the International Searching Authority for International Application No. PCT/EP2011/055149.

(Continued)

*Primary Examiner* — Mickey Yu
*Assistant Examiner* — Brijesh V. Patel
(74) *Attorney, Agent, or Firm* — Buchanan Ingersoll & Rooney PC

(57) ABSTRACT

A closure for a container comprises: a pouring spout having a neck defining a pour opening and a cover portion closing one end of the neck; a cap fittable to, and removable from, the pouring spout; a cam for transforming rotation into a stroke having a rotational component and a translational component to couple/detach the cap with/from the pouring spout; a weakening line on the end of the neck; first opening promoting mechanism on the cover portion; and second opening promoting mechanism on the cap to engage the first opening promoting mechanism upon removing the cap from the pouring spout to separate the cover portion from the neck along the weakening line; the first and second opening promoting mechanisms comprise at least one further cam element arranged along an angular portion of the annular periphery of the cover portion to enhance lifting thrust produced by the cap on the cover portion.

22 Claims, 5 Drawing Sheets

(56) References Cited

U.S. PATENT DOCUMENTS

| | | | | |
|---|---|---|---|---|
| 4,493,427 | A * | 1/1985 | Wolkonsky | 215/252 |
| 4,526,279 | A * | 7/1985 | Weiler et al. | 215/48 |
| 5,090,581 | A * | 2/1992 | Rose et al. | 215/48 |
| 5,176,271 | A * | 1/1993 | Painchaud et al. | 215/261 |
| 5,884,788 | A * | 3/1999 | Wilde | 215/252 |
| 6,581,793 | B1 * | 6/2003 | Racine et al. | 215/350 |
| 7,780,024 | B1 * | 8/2010 | Marsella et al. | 215/350 |
| 8,251,236 | B1 * | 8/2012 | Robinson et al. | 215/350 |
| 2004/0026421 | A1 | 2/2004 | Holm et al. | |
| 2007/0090110 | A1 * | 4/2007 | Skelton et al. | 215/252 |
| 2007/0125785 | A1 * | 6/2007 | Robinson et al. | 220/351 |
| 2007/0131641 | A1 * | 6/2007 | Higgins | 215/252 |
| 2008/0083694 | A1 * | 4/2008 | Ammann | 215/316 |
| 2008/0296248 | A1 | 12/2008 | Benedetti et al. | |
| 2009/0184082 | A1 * | 7/2009 | Antier et al. | 215/216 |
| 2010/0140208 | A1 * | 6/2010 | Parrinello et al. | 215/44 |
| 2010/0140271 | A1 * | 6/2010 | Benedetti et al. | 220/361 |
| 2010/0258563 | A1 | 10/2010 | Parrinello et al. | |

FOREIGN PATENT DOCUMENTS

| | | | |
|---|---|---|---|
| EP | 2 000 417 | A1 | 12/2008 |
| JP | 9-2505 | A | 1/1997 |
| JP | 11-278522 | A | 10/1999 |
| JP | 2002-370765 | A | 12/2002 |
| JP | 2005-145494 | A | 6/2005 |
| JP | 2007-261599 | A | 10/2007 |
| WO | WO 2008/148764 | A2 | 12/2008 |

OTHER PUBLICATIONS

Written Opinion (PCT/ISA/237) issued on May 17, 2011, by the European Patent Office as the International Searching Authority for International Application No. PCT/EP2011/055149.

Chinese Office Action dated May 8, 2014, issued by the Chinese Patent Office in corresponding Chinese Patent Application No. 201180017379 (13 pages).

Japanese Office Action dated Jun. 17, 2014, issued by the Japanese Patent Office in corresponding Japanese Patent Application No. 2013-501870 and English language translation of Office Action (9 pages).

* cited by examiner

CLOSURE FOR A CONTAINER

TECHNICAL FIELD

The present invention relates to a closure for a container, in particular a closure for a container of pourable food products.

BACKGROUND ART

As it is known, many pourable food products, such as fruit juice, milk, tomato sauce and beverages in general, are sold in a wide range of containers of different types and sizes, such as: parallelepiped-shaped packages made of multilayer, plastic- and/or paper-based, laminated materials or so-called multilayer cardboard materials; beaker-shaped plastic packages; blow-molded bottles; or glass, sheet metal or aluminium containers.

All these containers are fitted with closures which can be opened to allow access by the consumer to the food product, either to pour it into a drinking vessel or consume it straight from the container.

Screw cap closures are commonly used on bottle-type containers, whereas containers made of multilayer cardboard materials are often simply provided with tear-off markers, or with pour openings formed in the containers and covered with pull tabs.

Containers made of multilayer cardboard materials are also known to be fitted with plastic closures injection molded directly onto the containers, about openings formed through the packaging material, so as to completely close and seal the openings. Closures of this sort normally define the pour opening of the container, which may be fitted, for example, with a screw or snap cap.

Another type of container is also known which comprises a main portion made of multilayer cardboard material, and a top, for pouring the liquid or pourable product in the container, made of plastic material and produced by blowing a plastic tubular preform or by thermoforming or even by other suitable forming techniques, such as compression or injection molding.

An example of a plastic top for this type of containers is illustrated in international patent application No. WO2008/148764.

In this case, the plastic top basically comprises a pouring spout, defining the pour opening by which to pour the food product out of the container, and a cylindrical cap fitted to the pouring spout in a removable way.

The pouring spout may have one layer of gas- and/or light-barrier material, e.g. EVOH, and is produced, and attached to the container, in a closed configuration. In particular, the pouring spout comprises a substantially cylindrical tubular neck defining the pour opening and a cover portion integral with the neck and closing the pour opening.

More specifically, the neck has a bottom open end adapted to be attached to the container and a top end closed by the cover portion and provided with a weakening line, along which the cover portion can be detached from the neck when the container is opened by the user for the first time.

The cap is formed by an annular cylindrical lateral wall, which has an internal thread for engaging a corresponding thread provided on an outer lateral surface of the neck, and by a disk-shaped top wall for covering, in use, the top of the pouring spout.

In order to obtain the detachment of the cover portion from the neck, the lateral wall of the cap is provided with opening promoting means arranged for engaging further opening promoting means of the cover portion upon removal of the cap from the pouring spout to separate the cover portion from the neck along the weakening line.

In particular, according to one of the embodiments illustrated, the opening promoting means are defined by tab means having an end hinged to the lateral wall of the cap and an opposite end arranged for interacting with the further opening promoting means; the tab means may comprise a plurality of distinct tabs or a continuous tab extending through the whole circumference of the neck.

Alternatively, the opening promoting means may comprise hook means projecting inside the cap.

In both cases, the further opening promoting means for cooperating with the tab or hook means comprise an annular rim of the cover portion radially protruding outwards so as to form an abutment surface transversal to the axis of the pouring spout.

The first opening of the container is accomplished by rotating the cap around its axis; thanks to the interaction of the threads, the cap is advanced along a stroke comprising a rotational component about its axis and a translational component along the same axis.

During this movement, the tab or hook means of the cap contact the protruding rim of the cover portion and slide therealong according to the pitch of the threads so exerting a lifting action on such rim for producing the detachment of the cover portion from the neck at the weakening line.

This kind of solution requires an extended sliding interaction between the tab or hook means and the protruding rim to obtain opening of the neck; the consequences are a relatively high friction of the surfaces into contact and a too large effort required to the user to reach the appropriate level of tension in the plastic material to obtain fracture.

DISCLOSURE OF INVENTION

It is therefore an object of the present invention to provide a closure for a container, which is designed to eliminate the aforementioned drawbacks in a straightforward and low-cost manner.

This object is achieved by a closure for a container, as claimed in claim 1.

BRIEF DESCRIPTION OF THE DRAWINGS

A number of preferred, non-limiting embodiments of the present invention will be described by way of example with reference to the accompanying drawings, in which.

BEST MODE FOR CARRYING OUT THE INVENTION

Figure 1:
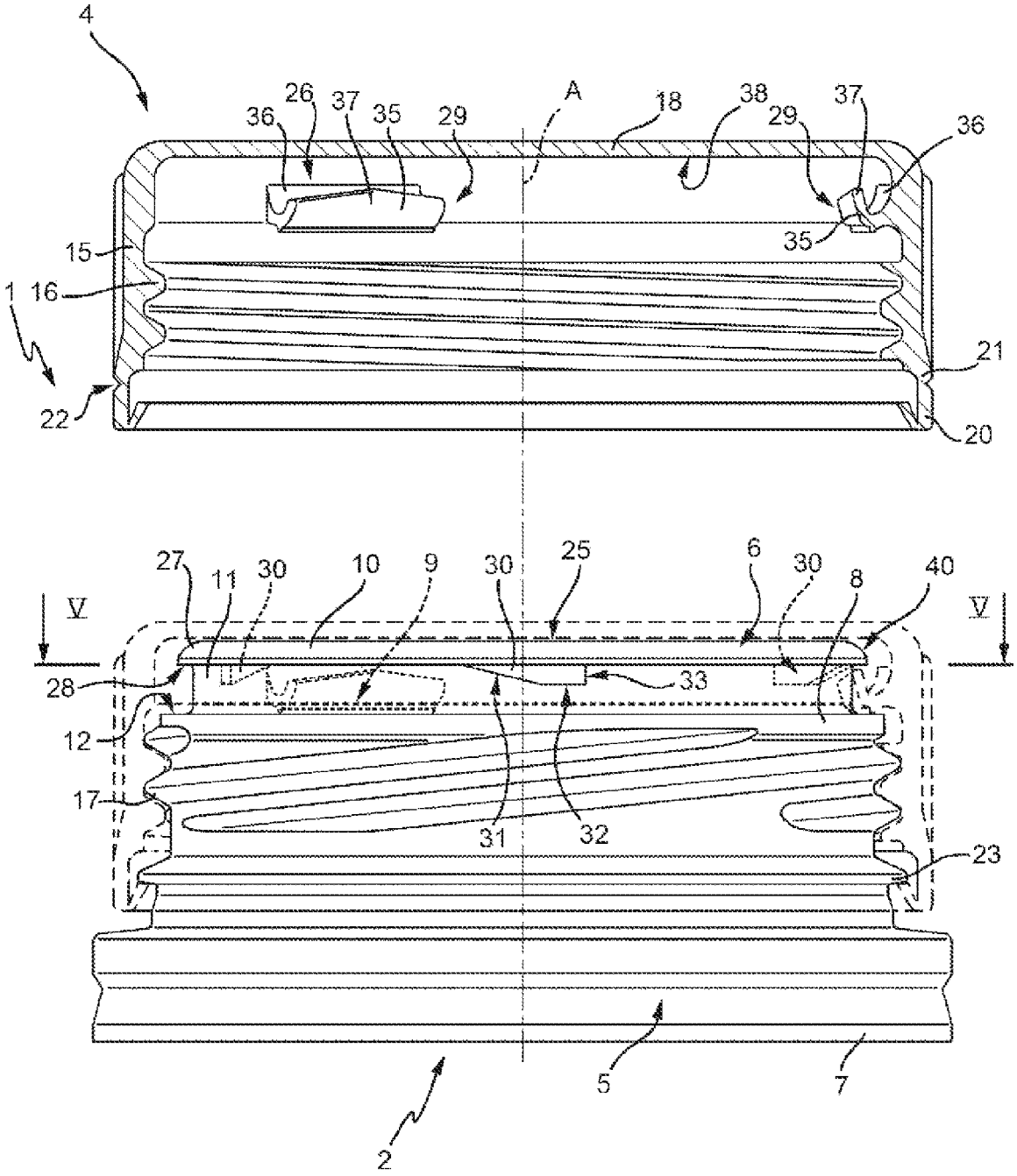
FIG. 1 shows an exploded vertical section of a closure, in accordance with the present invention, for a sealed container of a pourable food product.
Figure 2:
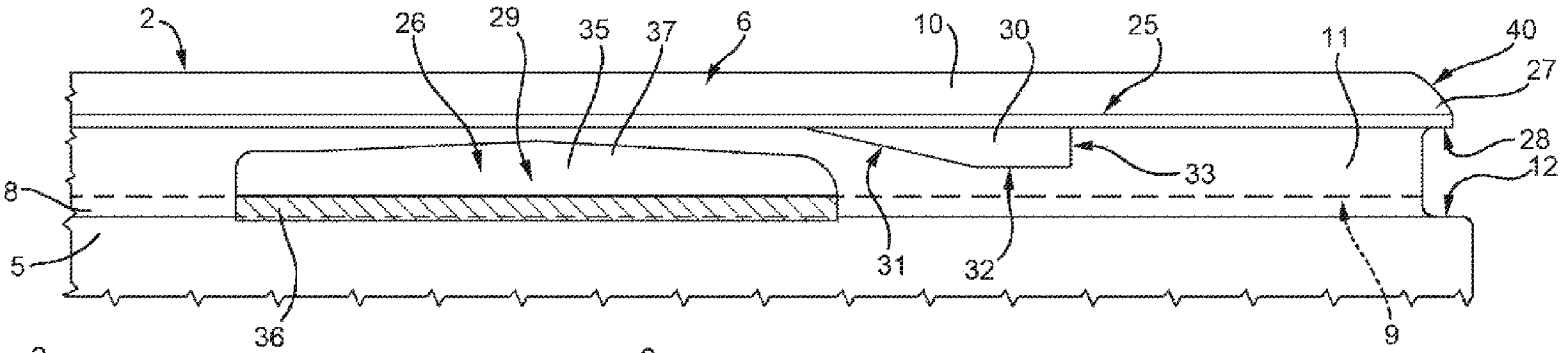
FIGS. 2 to 4 show a larger-scale, partially sectioned detail of the FIG. 1 closure, which is represented in different operating steps during the first opening of the closure and as though it were cut open on a plane for the sake of clarity.

Number 1 in FIG. 1 indicates as a whole a closure for a container (not shown) of liquid or pourable food products, such as a plastic closure for a combined cardboard-plastic container—to which the following description refers purely by way of example.

Closure 1 has a longitudinal axis A and basically comprises a pouring spout 2, defining a pour opening 3 by which to pour the food product out of the container, and a cylindrical cap 4 fitted to pouring spout 2 in a removable way.

Pouring spout 2 may be applied to a top part or end wall of the container or even configured to define integrally the complete top of the container.

Pouring spout 2 may define a gas- and/or light-barrier and is produced, and attached to the container, in a closed configuration.

In particular, pouring spout 2 comprises a substantially cylindrical tubular neck 5 defining pour opening 3 and a cover portion 6 integral with neck 5 and closing pour opening 3.

More specifically, neck 5 has a bottom open end 7 adapted to be attached to the container and a top end 8 closed by cover portion 6 and provided with a weakening line 9, along which the cover portion 6 can be detached from the neck 5 when closure 1 is opened by the user for the first time.

Weakening line 9 may extend along the entire annular peripheral region of top end 8 of neck 5 or only along one or more zones thereof; in the first case, weakening line 9 may consist of one continuous, non-through annular incision provided through the thickness of top end 8 of neck 5, whilst, in the second case, the weakening line 9 may consist of a plurality of said incisions spaced to each other.

In the example shown, cover portion 6 comprises a disk-shaped wall 10 orthogonal to axis A and having an axially protruding cylindrical annular edge 11 connected integrally to top end 8 of neck 5 through weakening line 9. As visible in FIG. 1, cylindrical edge 11 has a diameter smaller than the diameter of top end 8 of neck 5 and is connected to the latter through a flat annular surface 12 orthogonal to axis A and parallel to wall 10.

Cap 4 is produced in a single piece and is substantially defined by an annular cylindrical lateral wall 15, which has an internal thread 16, with one or more starts, for engaging a corresponding thread 17 provided on an outer lateral surface of neck 5, and by a disk-shaped top wall 18 for covering, in use, the top of pouring spout 2, and specifically wall 10 of cover portion 6.

In an alternative embodiment not shown, lateral wall 15 of cap 4 may be internally provided with one or more cam projections suitable for engaging one or more corresponding projections on neck 5.

In other words, a cam arrangement is provided between cap 4 and neck 5 in order to allow the cap 4 to be fitted to and removed from pouring spout 2 along a stroke having a translational component parallel to axis A and a rotational component about such axis; this cam arrangement may be defined by the threads 16, 17, as shown in the example of the enclosed Figures, or even by proper cam devices.

Cap 4 is molded integrally, in the usual way, with a respective tamperproof ring 20 connected coaxially to a bottom edge 21 of lateral wall 15 by breakable connecting means 22, such as one annular breakable bridge or a number of radial breakable bridges.

Cap 4 is fitted initially to pouring spout 2 in a completely closed or sealed position (FIG. 1, dotted line), wherein the cap is screwed completely onto neck 5, with bottom edge 21 and tamperproof ring 20 still connected to each other and resting on opposite sides of an annular rib 23 extending on the neck 5 at a lower position than thread 17 with respect to axis A.

According to a possible alternative not shown, bottom edge 21 and tamperproof ring 20 may rest on opposite sides of a bottom portion of thread 17 of neck 5.

Closure 1 further comprises first opening promoting means 25 provided on the annular periphery of cover portion 6, and second opening promoting means 26 provided on an inner surface of lateral wall 15 of cap 4 and arranged for engaging the first opening promoting means 25 upon removal of the cap 4 from the pouring spout 2 to separate cover portion 6 from neck 5 along the weakening line 9.

In particular, first opening promoting means 25 comprise an annular rim 27 of top wall 10 of cover portion 6 radially protruding outwards with respect to annular edge 11 so as to form an abutment surface 28 orthogonal to axis A; and second opening promoting means comprise at least one opening element 29 provided along an angular portion of the inner surface of lateral wall 15 of cap 4 and arranged to cooperate with the first opening promoting means 25.

Advantageously, first opening promoting means 25 further comprise at least one cam element 30 arranged along an angular portion of annular edge 11 and annular rim 27 for cooperating with opening element 29 along a portion of the removal stroke of the cap 4 from pouring spout 2, and configured to enhance locally the translational component produced by thread 17 on thread 16 of cap 4 during such removal stroke.

In this way, when the cap 4 is rotated by the user about axis A for opening the closure 1 for the first time, the interaction of the opening element 29 with the cam element 30 produces a sudden change in the gear ratio defined by the pitch of threads 16, 17 and a consequent corresponding increase of the tension in the plastic material so as to achieve a local fracture at a point of the weakening line 9 corresponding to the zone where the cam element 30 is placed or immediately adjacent thereto.

According to a preferred embodiment, first opening promoting means 25 comprise two or more cam elements 30, in the example shown three, angularly spaced to each other around axis A; in the same manner, second opening promoting means 26 comprise a number of opening elements 29 corresponding to the number of cam elements 30.

Figure 5:
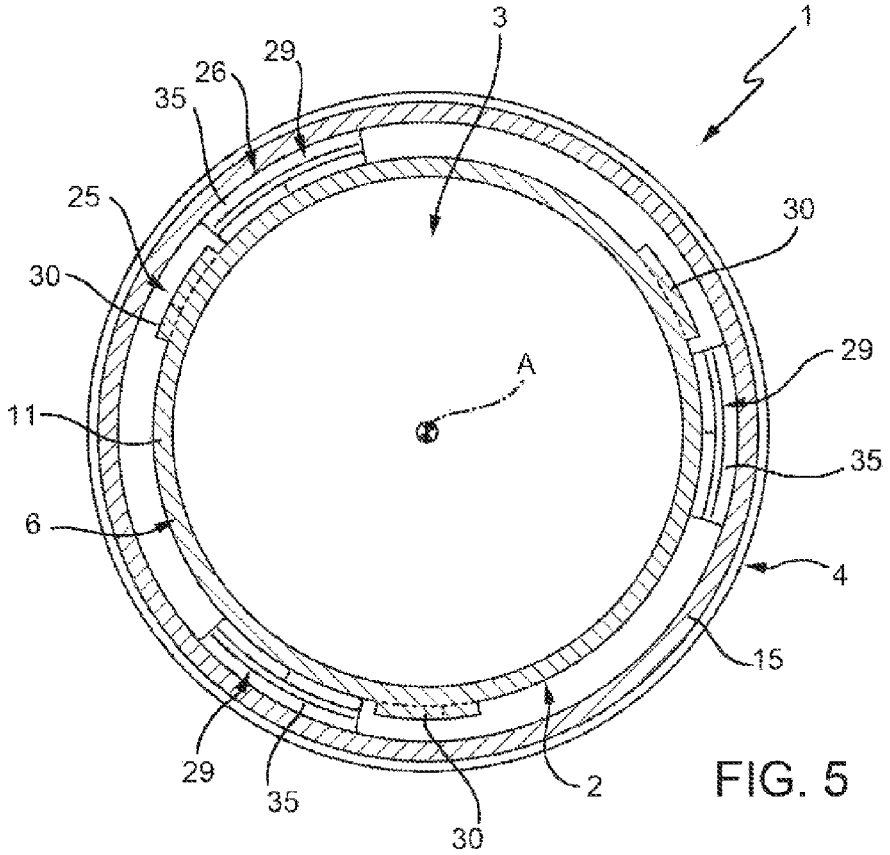
FIG. 5 shows a smaller-scale section along line V-V in FIG. 1.

According to the solution shown in FIGS. 1 and 5, cam elements 30 are equally spaced angularly to each other around axis A and the same occurs for opening elements 29.

As visible in FIG. 1, cam elements 30 protrude outwards from annular edge 11 and even from annular rim 27 towards neck 5 and weakening line 9.

In the example shown, cam elements 30 are identical to each other and have right-angled trapezium-shaped profiles.

In particular, by proceeding in the direction of rotation of cap 4 during removal from pouring spout 2, each cam element 30 is delimited, towards neck 5, by a first ramp-shaped edge 31 extending obliquely with respect to axis A, by a second edge 32 parallel to rim 27 and orthogonal to axis A and by a third edge 33 parallel to axis A. In the example shown in FIGS. 1 to 5, all edges 31, 32 and 33 have flat configurations.

More specifically, ramp-shaped edge 31 has, in a direction parallel to axis A, a distance from top end 8 of neck 5 decreasing in the direction of rotation of cap 4 during removal from pouring spout 2.

Advantageously, ramp-shaped edge 31 of each cam element 30 is inclined in an opposite way with respect to the adjacent portion of thread 17, i.e. the portion of thread 17 arranged below said cam element 30.

It is pointed out that ramp-shaped edge 31 may also comprise a plurality of portions having different inclinations or may have a curvilinear shape.

Figure 8:
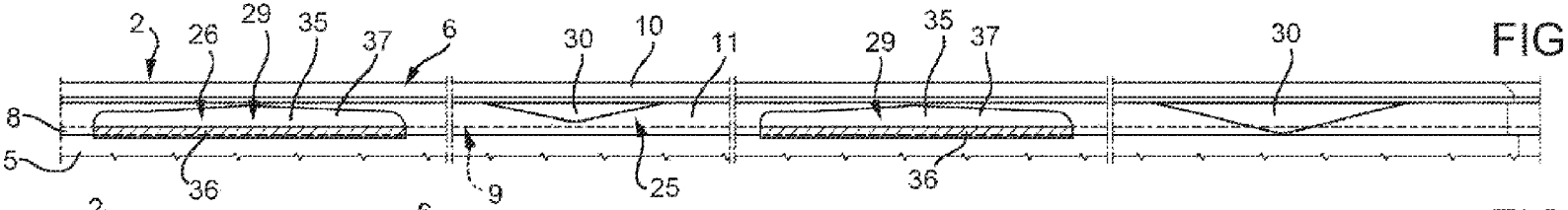
FIGS. 8 and 9 are smaller-scale views analogous to the ones of FIGS. 2 to 4, which show two more possible variants of the FIG. 1 closure represented as though the closure were cut open on a plane for the sake of clarity.
Figure 9:
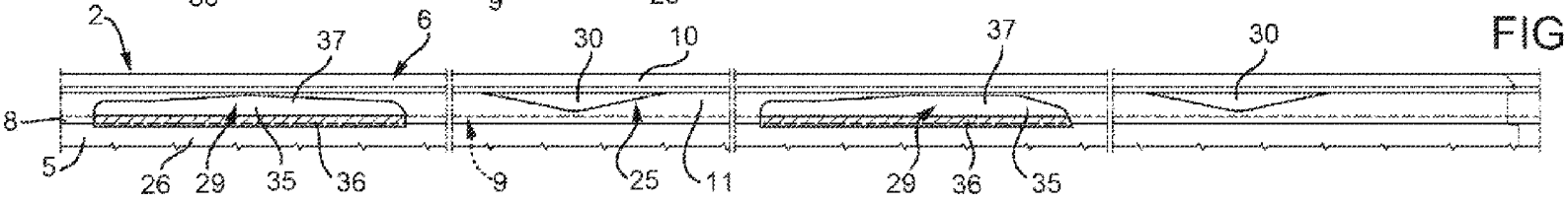

Moreover, the cam elements 30 may have different profiles, such as isosceles trapezium-shaped or even triangle-shaped, as shown for instance in FIGS. 8 and 9.

In the example shown in FIGS. 1 to 5, each opening element 29 comprises a flap 35 having one end 36 hinged on the inner surface of lateral wall 15 of cap 4 at a higher position than thread 16 with respect to axis A, and one opposite free end 37 arranged for interacting with the relative cam element 30.

As illustrated in FIG. 1, each flap 35 has a variable height, which, starting from an intermediate section thereof, decreases in the same way proceeding towards its opposite angular ends.

Flaps 35 are configured in such a way that cover portion 6 is retained by the cap 4 after being removed from the neck 5. In particular, cover portion 6 is retained in a containing zone 38 of cap 4 defined by top wall 18, flaps 35 and the part of lateral wall 15 limited therebetween.

During fitting of cap 4 onto pouring spout 2 to obtain closure 1, flaps 35 are elastically deformed in such a way that cover portion 6 is received inside the containing zone 38 and cannot come off the latter unintentionally, i.e. without being deliberately extracted by the user.

In order to ease engagement of cover portion 6 into containing zone 38 of cap 4 when the latter is coupled with the pouring spout 2, the annular rim 27 is delimited, on the opposite side of abutment surface 28, by a rounded or convex surface 40.

As shown in FIG. 5, before the cap 4 is removed from the pouring spout 2 for the first time, each cam element 30 and the corresponding opening element 29 are separated by a preset angular distance around axis A; this distance can be defined in such a way to obtain, during the first opening of closure 1, separation of tamperproof ring 20 from bottom edge 21 of lateral wall along breakable connecting means 22 before each opening element 29 starts to interact with the respective cam element 30 or even before the sudden increase of the force transmitted from the cap 4 to the cover portion 6 is produced as a result of the action of such cam element 30.

Moreover, before the cap 4 is removed from the pouring spout 2 for the first time, the free end 37 of each opening element 29 may be at a preset axial distance from the surface 28 of the annular rim 27 as shown in FIGS. 1 to 4, or even in contact with the latter.

In use, the first opening of the container is obtained in a single step by unscrewing cap 4 off pouring spout 2.

As cap 4 is turned about axis A anticlockwise in FIG. 1, mating threads 16 and 17 simultaneously move cap 4 axially away from pouring spout 2 so as to break connecting means 22; as a result of this action, tamperproof ring 20 is retained resting axially against annular rib 23 of neck 5.

Upon further rotation of cap 4, each opening element 29 comes into contact with the respective cam element 30. In this condition, the leading edge of each flap 35 in the direction of rotation of cap 4 slides along the ramp-shaped edge 31 of the relative cam element 30; the result is a sudden increase of the lifting thrust or force or action along axis A produced by the cap 4 on the cover portion 6.

In practice, as a consequence of the contact of each opening element 29 with the ramp-shaped edge 31 of the respective cam element 30, the opening element 29 moves away from annular rim 27.

Figure 3:
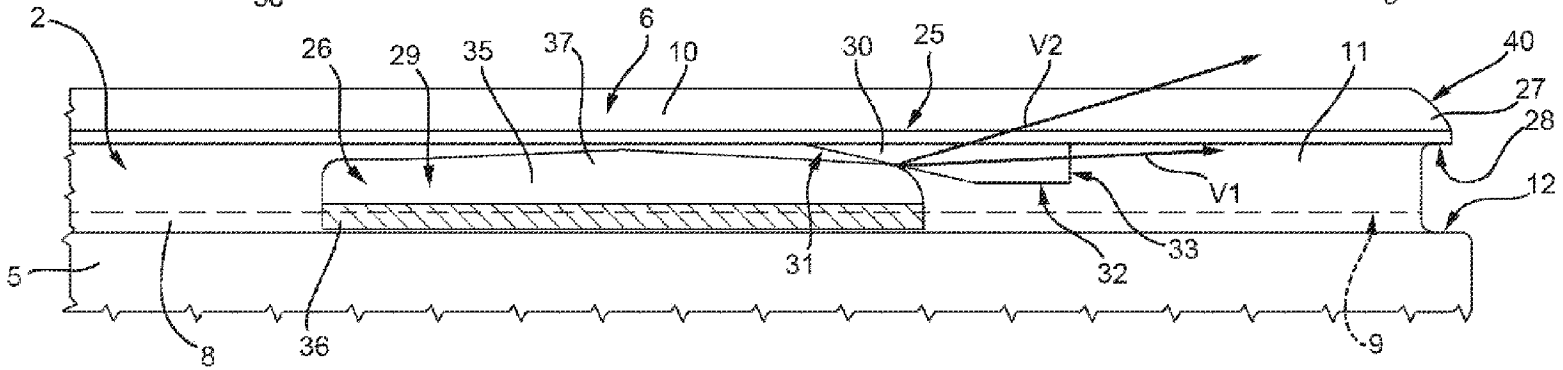
Figure 4:
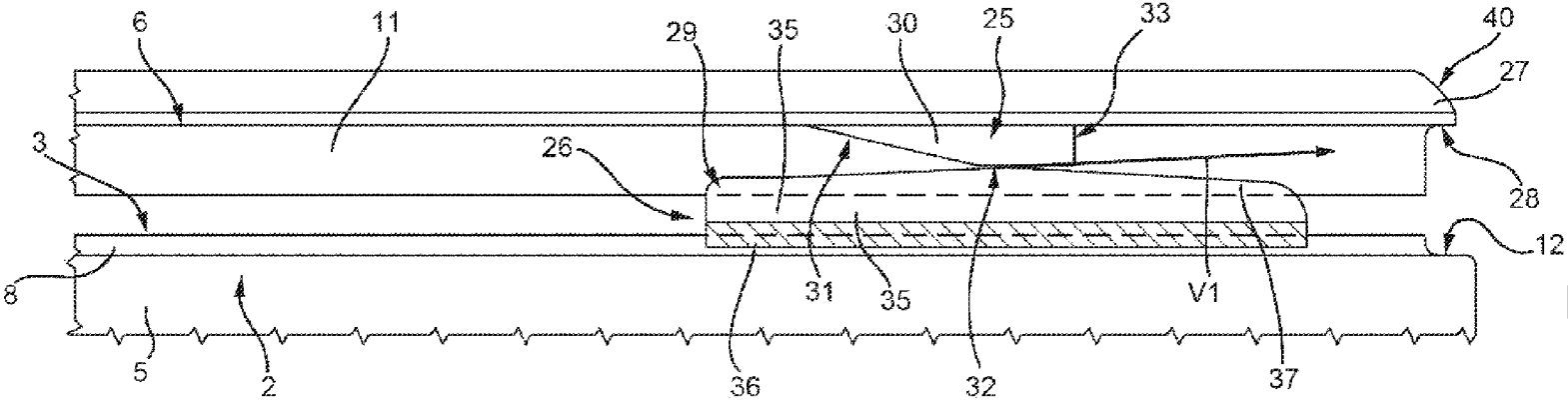

In FIGS. 3 and 4, reference V1 indicates the displacement vector of cap 4 as resulting by the action of threads 16 and 17 only, whilst reference V2 indicates the induced displacement vector on cover portion 6 as resulting by the combined action of threads 16, 17 with cam elements 30 and flaps 35. As it is clearly visible, the effect of cam elements 30 is a sudden increase of the lifting action or thrust produced by cap 4 on cover portion 6 along axis A, with a consequent sudden increase of the tension of the plastic material.

By continuing the rotation of the cap 4, each flap 35 reaches the edge 32 of the relative cam element 30, where the maximum level of the material tension is produced so determining at least the start of the breaking of the weakening line 9 and therefore at least the start of the detachment of the cover portion 6 from the neck 5.

In practice, the interaction of each opening element 29 with the relative cam element 30 has the effect of amplifying locally the vertical action produced by threads 16, 17 on the movement of the cap 4.

Furthermore, the cam elements 30 allow the points of application of the forces induced by the opening elements 29 to move progressively closer to the weakening line 9 so as to be accordingly more effective for the breaking (this effect is particularly evident when the material of the neck 5 and the cover portion 6 has a certain degree of deformability).

Also, the cam elements 30 act as a "mass concentration", which allow an amplified local deformation of the spout 2 useful to reduce the breaking force.

The presence of cam elements 30 on cover portion 6 permits to increase the lifting thrust or action produced by the cap 4 without requiring an increase of the pitch of the threads 16, 17.

Clearly, the final result is a relevant reduction of the effort required to the user to obtain the first opening of the container.

The completion of the detachment of cover portion 6 from neck 5 can occur directly when opening elements 29 are still in contact with the respective cam elements 30 or even after the end of such contacts, this depending on the deformability of the plastic material of the spout 2.

When cap 4 is completely removed from pouring spout 2, cover portion 6 is retained within the containing zone of the cap 4 so as not to come off the latter unintentionally.

The container can be closed again by simply screwing cap 4 onto pouring spout 2.

Figure 6:
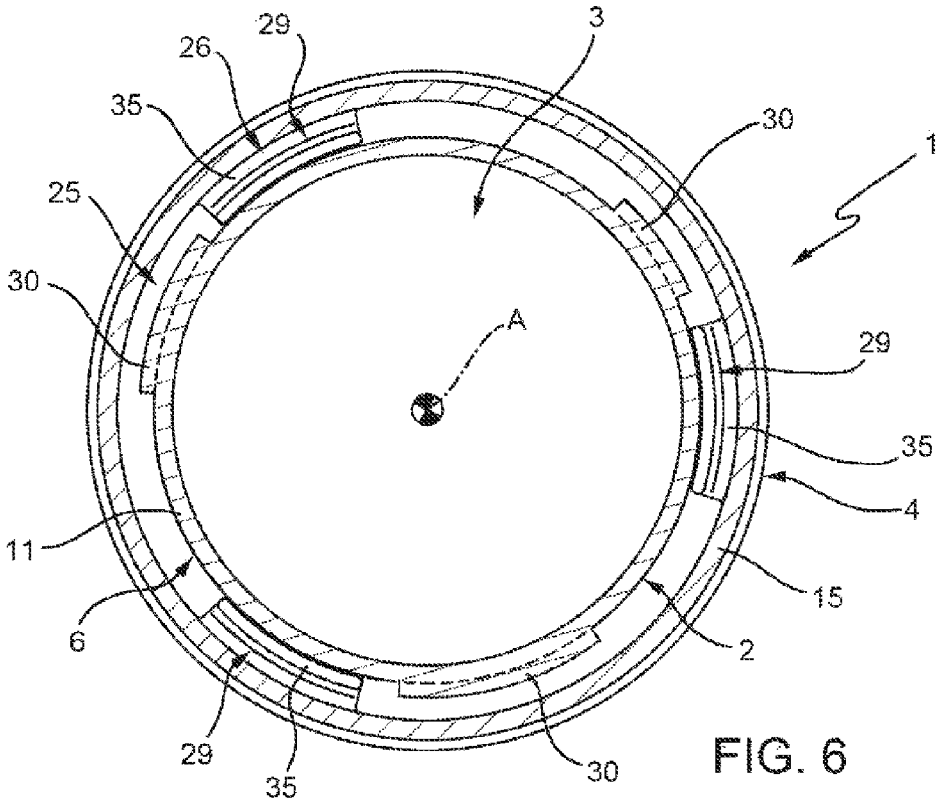
FIG. 6 is a section analogous to the one of FIG. 5 showing a possible variant of the FIG. 1 closure.

The variant of FIG. 6 relates to a different configuration of the cam elements 30, which are arranged along the annular cylindrical edge 11 and the annular rim at different angular distances from each other; moreover, the cam elements 30 also have different angular extensions around axis A.

In this way, it is possible to tune the interaction of the different opening elements 29 with the respective cam elements 30 during the angular movement of the cap 4 around axis A so as to obtain a progressive breaking action of the plastic material along the weakening line 9 with a particularly low opening torque required to the user.

This effect may be also obtained or enhanced by positioning the cam elements 30 at different initial angular distances from the respective opening elements 29, as depicted in FIG. 6.

During the first opening of the container, the fracture of the plastic material along the weakening line 9 may occur in different ways according to the sequence of interaction of the opening elements 29 with the cam elements 30: for instance, the first local fracture of the plastic material may occur during the first interaction between the angularly closer opening element 29 and cam element 30 and at a zone of the weakening line 9 facing said cam element 30; in the case of the second pair of the interacting opening element 29 and cam element 30, the local fracture of the weakening line 9 may even occur after completion of said interaction and may also result in a complete breaking of the weakening line 9.

Figure 7:
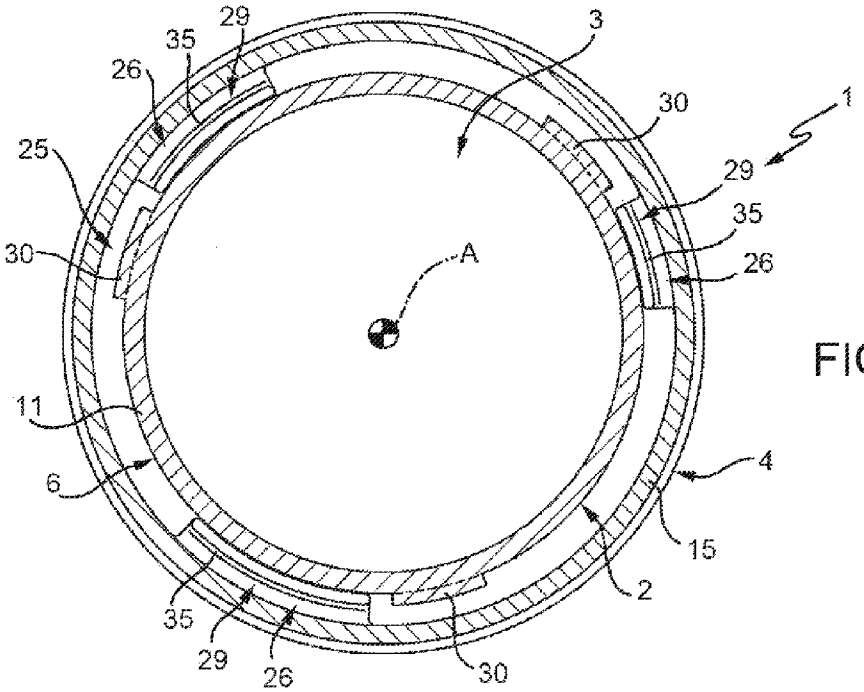
FIG. 7 is a section analogous to the one of Figure showing another possible variant of the FIG. 1 closure.

The variant of FIG. 7 relates to a different configuration of the opening elements 29, which are arranged along the inner surface of lateral wall 15 of cap 4 at different angular distances from each other; moreover, in this case, the opening elements 29 also have different angular extensions around axis A.

The effects of this solution are analogous to the ones of the solution of FIG. 6.

As shown in the variants of FIGS. 8 and 9, the cam elements 30 and/or the opening elements 29 may also have different profiles in order to increase the control of the breaking action of the plastic material and consequently to obtain an opening torque well accepted by the users.

According to another possible variant not shown, the first and second opening promoting means 25, 26 may also comprise one opening element 29 arranged for interacting with two or more successive cam elements 30.

According to a further possible variant not shown, opening elements 29 may be carried by the cover portion 6 and the cam elements 30 may be provided on the lateral wall 15 of the cap 4.

Figure 10:
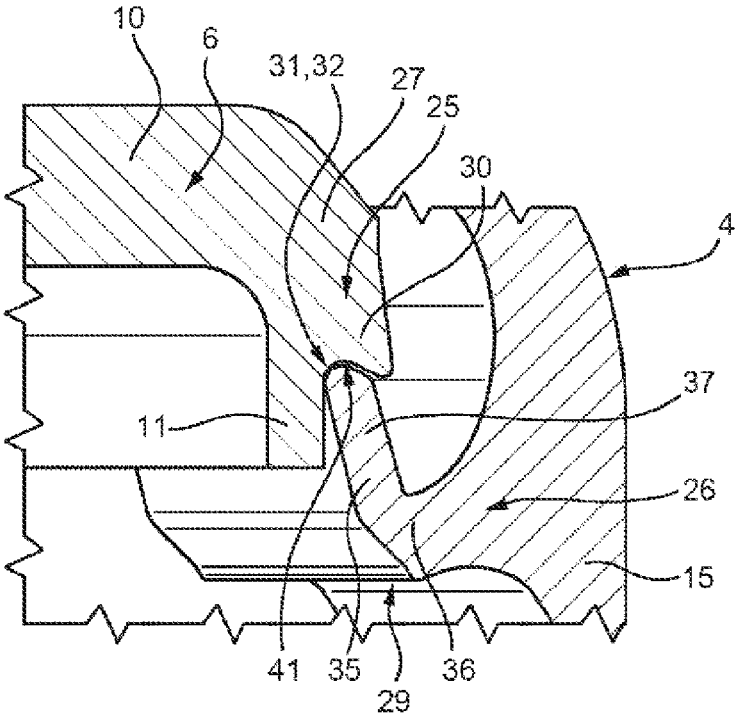
FIG. 10 shows a larger-scale detail of an additional possible variant of the FIG. 1 closure.

With reference to FIG. 10, the variant illustrated therein relates to a different configuration of the cam elements 30, whose edges 31, 32 cooperating with the respective flaps 35 have concave shapes; in particular, in this case, edges 31 and 32 of each cam element 30 define respective undercuts 41 to better retain the respective flaps 35 during interaction.

Figure 11:
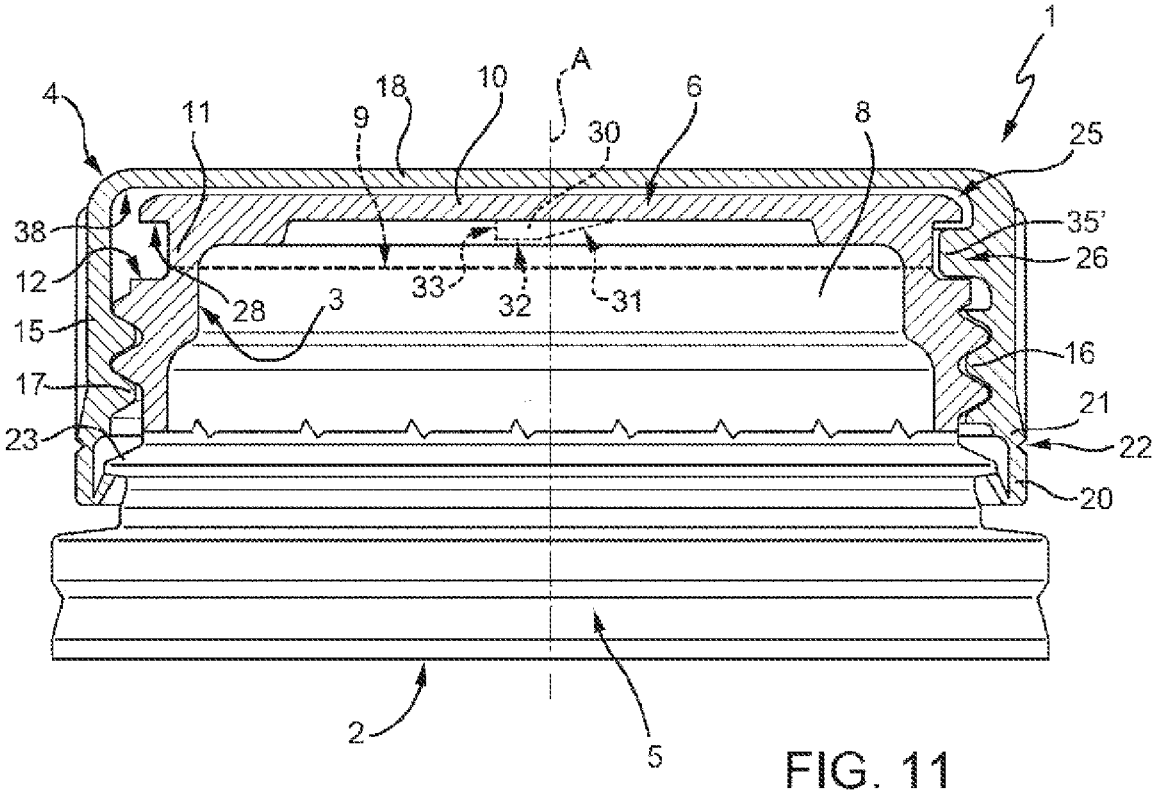
FIG. 11 shows a vertical section of a further possible variant of the FIG. 1 closure.

The variant of FIG. 11 relates to a different configuration of the opening elements 29, which, in this case, are defined by rigid hooks 35' projecting inside the cap 4.

The advantages of closure 1 will be clear from the foregoing description.

In particular, thanks to the fact that one or more cam elements 30 are added along the circumference of the cover portion 6 at given angular distances from one another, during the first opening of the container, the interaction of each opening element 29 with the corresponding cam element 30 produces a sudden increase of the lifting action on cap 4 along axis A.

In this way, the opening force is concentrated at certain limited zones of the circumference of the neck 5, so making possible a reduction of the opening torque required to the user to obtain the detachment of the cover portion 6 from the neck 5.

As mentioned above, by adjusting the number and the profiles of the cam elements 30 and/or of the opening elements 29 along the circumference of the cover portion and/or the cap 4 as well as their angular positions around axis A, it is possible to further ease the first opening of the container so as to minimize the opening torque.

Moreover, the working edge of the opening elements 29 is shaped so as to best act with the working edge of the respective cam elements 30.

Clearly, changes may be made to the closure 1 as described and illustrated herein without, however, departing from the scope as defined in the accompanying claims.

The invention claimed is:

1. A closure for a container comprising:

a pouring spout having a neck to define a pour opening and a cover portion closing one end of said neck;

a cap which can be rotated about a longitudinal axis to be fitted to, and removed from, the pouring spout;

a cam element for transforming a rotational force applied to said cap about said axis into a stroke of said cap having a rotational component about said axis and a translational component along said axis to couple/detach said cap with/from said pouring spout;

a weakening line provided on said end of said neck;

first opening promoting means provided on an annular outer periphery of said cover portion;

second opening promoting means provided on an annular inner periphery of said cap and arranged for engaging said first opening promoting means upon removal of said cap from the pouring spout to produce a lifting thrust on said cover portion along said axis so as to obtain at least a partial separation of the cover portion from said neck along the weakening line; and wherein said first and second opening promoting means comprise at least one further cam element arranged along an angular portion of the annular periphery of one of said cap and said cover portion and configured to enhance the lifting thrust produced by the cap on the cover portion as a result of the action of said cam element during removal of said cap from said pouring spout.

2. The closure as claimed in claim 1, wherein said first and second opening promoting means comprise at least one opening element provided along an angular portion of the annular periphery of another one of said cap and said cover portion and arranged to cooperate with said further cam element along a portion of the stroke of the cap when said cap is being removed from said pouring spout.

3. The closure as claimed in claim 2, wherein, before said cap is removed from said pouring spout for the first time, said further cam element and said opening element are separated by a preset angular distance around said axis.

4. The closure as claimed in claim 2, wherein said opening element is carried by said cap.

5. The closure as claimed in claim 4, wherein said opening element comprises a flap having one end hinged on the inner periphery of said cap, and one opposite free end arranged for interacting with said further cam element.

6. The closure as claimed in claim 4, wherein said opening element comprises a hook projecting inside said cap from the inner periphery thereof.

7. The closure as claimed in claim 2, further comprising two or more of said further cam elements angularly spaced from one another around said axis and/or two or more of said opening elements angularly spaced from one another around said axis.

8. The closure as claimed in claim 7, wherein said further cam elements are arranged at different angular distances from each other and/or said opening elements are arranged at different angular distances from each other.

9. The closure as claimed in claim 7, wherein said further cam elements are equally spaced angularly around said axis and/or said opening elements are equally spaced angularly around said axis.

10. The closure as claimed in claim 7, wherein said further cam elements have different angular extensions around said axis and/or said opening elements have different angular extensions around said axis.

11. The closure as claimed in claim 7, wherein said further cam elements have different profiles and/or said opening elements have different profiles.

12. The closure as claimed in claim 1, wherein said further cam element is carried by said cover portion.

13. The closure as claimed in claim 12, wherein said first opening promoting means comprise an annular rim protruding outwards from said cover portion, and wherein said further cam element is arranged along a portion of said annular rim and extends from said annular rim towards said neck.

14. The closure as claimed in claim 1, wherein said cam element comprise a first thread arranged on an outer lateral surface of said neck for engaging a second thread of said cap.

15. The closure as claimed in claim 14, wherein said further cam element is delimited by a cam edge for cooperating with said opening element and comprising at least one ramp-shaped portion inclined in an opposite way with respect to the adjacent portion of said first thread.

16. The closure as claimed in claim 15, wherein said cam edge defines an undercut to retain said opening element during interaction with said cam element.

17. The closure as claimed in claim 1, wherein said cam element comprises a first inclined surface and said further cam element comprises a second inclined surface, the first and second inclined surfaces being inclined in opposite directions relative to each other.

18. The closure as claimed in claim 1, wherein said further cam element comprises a projection extending from the first opening promoting means toward the neck and possessing an inclined end surface facing the cover portion.

19. The closure as claimed in claim 1, wherein said further cam element comprises a projection extending from the second opening promoting means toward the cover portion and possessing an inclined end surface facing the cover portion.

20. A container closure comprising:

a pouring spout comprising a neck, a pour hole extending through the neck and a cover spanning the pour hole to close an open end of the neck;

a cap rotatable about a longitudinal axis and removably attached to the pouring spout;

a first cam configured to transform a rotational force applied to the cap about the longitudinal axis into a detaching force having a rotational component about the longitudinal axis and a translational component along the longitudinal axis to detach the cap from the pouring spout;

a weakening line formed in the neck;

a first opening promoting member comprising an annular outer periphery of the cover;

a second opening promoting member comprising an annular inner periphery of the cap and configured to engage the first opening promoting member during removal of the cap from the pouring spout to separate the cover from the neck along the weakening line; and a second cam configured to amplify the translational component of the detaching force during removal of the cap from the pouring spout, the second cam comprising a first projection extending from the first opening promoting member toward the neck and possessing an inclined end surface facing toward the neck.

21. The container closure of claim 20, said second cam comprising a second projection extending from the second opening promoting member toward the cover and possessing an inclined end surface facing the cover, the inclined end surface of the second projection contacting the inclined end surface of the first projection during removal of the cap to amplify the translational component of the detaching force.

22. A container closure comprising:

a pouring spout comprising a neck, a pour hole extending through the neck and a cover spanning the pour hole to close an open end of the neck;

a cap rotatable about a longitudinal axis and removably attached to the pouring spout;

a first cam configured to transform a rotational force applied to the cap about the longitudinal axis into a detaching force having a rotational component about the longitudinal axis and a translational component along the longitudinal axis to detach the cap from the pouring spout;

a weakening line formed in the neck;

a first opening promoting member comprising an annular outer periphery of the cover;

a second opening promoting member comprising an annular inner periphery of the cap and configured to engage the first opening promoting member during removal of the cap from the pouring spout to separate the cover from the neck along the weakening line; and a second cam configured to amplify the translational component of the detaching force during removal of the cap from the pouring spout, the second cam comprising a first projection extending from the second opening promoting member toward the cover and possessing an inclined end surface facing the cover.

* * * * *